US010694278B2

(12) United States Patent
Ivey

(10) Patent No.: US 10,694,278 B2
(45) Date of Patent: Jun. 23, 2020

(54) SMALL SUBWOOFER CEILING SPEAKER SYSTEM

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 29 days.

(21) Appl. No.: 16/135,870

(22) Filed: Sep. 19, 2018

(65) Prior Publication Data

US 2019/0090047 A1 Mar. 21, 2019

Related U.S. Application Data

(63) Continuation-in-part of application No. 16/129,175, filed on Sep. 12, 2018, which is a continuation-in-part of application No. 15/710,654, filed on Sep. 20, 2017, now Pat. No. 10,237,636.

(51) Int. Cl.

| | |
|---|---|
| ***H04R 1/22*** | (2006.01) |
| ***G10K 11/26*** | (2006.01) |
| ***H04R 1/02*** | (2006.01) |
| ***H04R 1/28*** | (2006.01) |

(Continued)

(52) U.S. Cl.

CPC ..... *H04R 1/22* (2013.01); *G10K 11/26* (2013.01); *H04R 1/227* (2013.01); *H04R 1/023* (2013.01); *H04R 1/025* (2013.01); *H04R 1/26* (2013.01); *H04R 1/288* (2013.01); *H04R 1/345* (2013.01); *H04R 2201/021* (2013.01); *H04R 2201/029* (2013.01)

(58) Field of Classification Search

CPC ..... G10K 11/08; G10K 11/28; H04R 1/023; H04R 1/025; H04R 1/026; H04R 1/26; H04R 1/2884; H04R 1/2869; H04R 1/2892; H04R 1/2861; H04R 1/345; H04R 1/34; H04R 1/02; H04R 1/403; H04R 1/323; H04R 1/30; H04R 1/2896; H04R 1/2888; H04R 1/288; H04R 1/28; H04R 1/2803; H04R 1/2819; H04R 1/2823; H04R 2201/021; H04R 2201/028; H04R 2201/025; H04R 2201/029; H04R 2499/10; H04R 2205/026

See application file for complete search history.

(56) References Cited

U.S. PATENT DOCUMENTS 3,918,551 A * 11/1975 Rizo-Patron ..... H04R 1/403 181/144

4,923,031 A 5/1990 Carlson (Continued)

*Primary Examiner* — Fan S Tsang
*Assistant Examiner* — Angelica M McKinney
(74) *Attorney, Agent, or Firm* — Keith L. Jenkins, Registered Patent Attorney, LLC; Keith L. Jenkins

(57) ABSTRACT

A pair of subwoofer speakers mounted on a carrier in a ceiling speaker enclosure having a small acoustic port using an acoustic channel shell that extends from the enclosure, the output of which is directed by adjustable attachment of a director to the acoustic channel shell. An annular flange on the director is used to clamp to a bottom surface of a ceiling tile. The enclosure has braces for engaging grid members of a suspended ceiling support grid. The braces are independently extendable from the enclosure. The subwoofer speakers at least partially face each other. Vibration damping approaches are used. An audio controller may be used to control the phases of the audio signals to the subwoofer speakers to permit a push-pull synchronization strategy.

19 Claims, 7 Drawing Sheets

(51) Int. Cl.
*H04R 1/34* (2006.01)
*H04R 1/26* (2006.01)

(56) References Cited

U.S. PATENT DOCUMENTS

| | | | | |
|---|---|---|---|---|
| 5,898,138 | A * | 4/1999 | Delgado, Jr. | H04R 1/403 181/152 |
| 6,604,502 | B1 | 8/2003 | Kim | |
| 7,590,257 | B1 * | 9/2009 | Blanchard | H04R 1/345 381/339 |
| 7,624,839 | B1 * | 12/2009 | Graber | H04R 1/22 181/145 |
| 2001/0011862 | A1 | 8/2001 | Weikel et al. | |
| 2006/0231326 | A1 * | 10/2006 | Iwayama | H04R 1/025 181/150 |
| 2007/0284183 | A1 | 12/2007 | Whitaaker | |
| 2012/0002835 | A1 | 1/2012 | Stewart et al. | |
| 2013/0251181 | A1 * | 9/2013 | Stewart, Jr. | H04R 1/025 381/332 |

* cited by examiner

SMALL SUBWOOFER CEILING SPEAKER SYSTEM

RELATIONSHIP TO OTHER APPLICATIONS

The present application is a continuation-in-part of U.S. patent application Ser. No. 15/710,654 filed Sep. 20, 2017 by the same inventor.

FIELD OF ART

The present invention relates to ceiling mounted loudspeakers having a small form factor and direct sound delivery. The present invention more particularly relates to a small subwoofer speaker system with a director that can adjust over a range of thicknesses of ceiling tiles and can be used interchangeably with the diffuser of the Small Ceiling Speaker System of U.S. patent application Ser. No. 15/710,654.

BACKGROUND OF THE INVENTION

Ceiling speakers are used in suspended ceilings, typically for public address, alarm, or musical entertainment purposes. Many ceiling speakers are designed for predetermined thicknesses of ceiling tile. Many ceiling speakers also load the ceiling tile which can cause deformation or failure of the tile over time. Direct fire speakers are useful in sound masking applications.

SUMMARY OF THE INVENTION

Briefly described, the invention includes an interchangeable part for applicant's previously filed small ceiling speaker system US patent application that provides direct downward projection of sound ("direct fire") from a small ceiling speaker with a variable adjustable length sound director that is adjustable over a range of ceiling tile thicknesses. The portion of the small ceiling speaker that is above the ceiling tile is preferably supported in an enclosure that is supported directly by the grid of ceiling tile supports, and not on the tiles per se. The portion of the small ceiling speaker that is below the ceiling tile is small. The sound director includes a flanged cylindrical shell body for adjustably coupling to the acoustic channel shell of the Small Ceiling Speaker System of U.S. patent application Ser. No. 15/710,654, a direct fire ring, a magnetically attachable and releasable grill, and appropriate couplings.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 8:
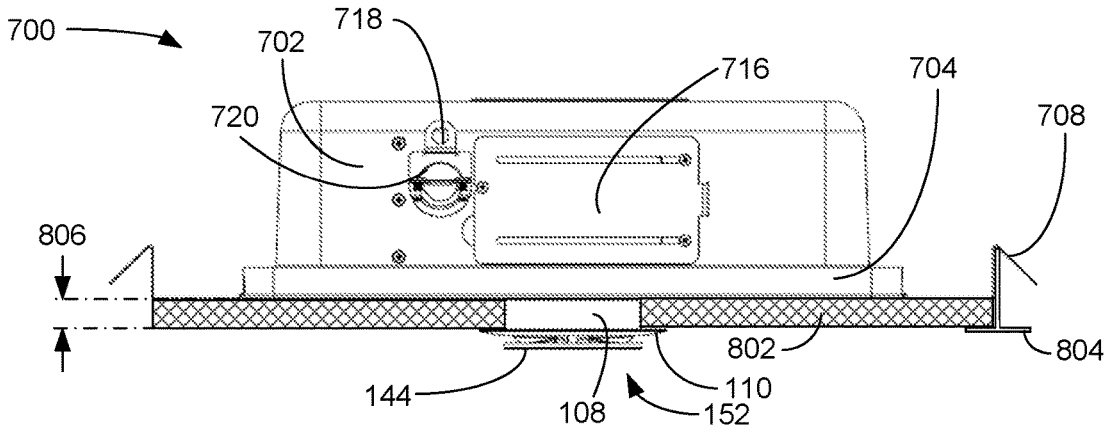
FIG. 8 is a side elevation view illustrating the exemplary embodiment of the direct fire small ceiling subwoofer speaker system of FIG. 7, according to a preferred embodiment of the present invention.
Figure 10:
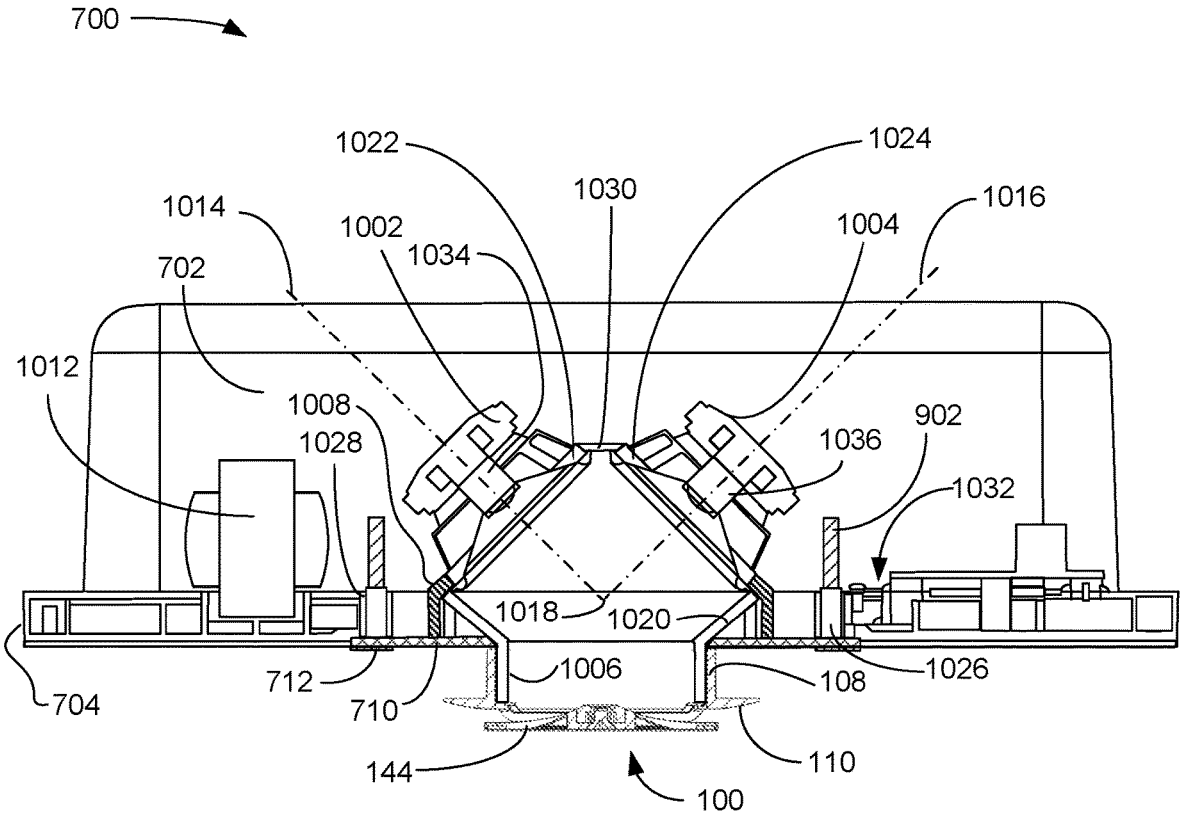
FIG. 10 is a cross sectional elevation view through cross section BB illustrating the exemplary embodiment of the direct fire small ceiling subwoofer speaker system of FIG. 1 and FIG. 7, according to a preferred embodiment of the present invention.

As used and defined herein, "top", "bottom", "upper", "lower", "upward", and "downward" are referenced to the present invention in its installed orientation, as illustrated in FIG. 8 and FIG. 10. As used and defined herein, "speaker" means "subwoofer", as shown in FIG. 10. As used and defined herein, "director", without more, means an acoustic director for projecting sound. The claims below contain functional claim language and do not contain any statements of intended use.

The specification and drawings of the Small Ceiling Speaker System of U.S. patent application Ser. No. 15/710,654 is hereby incorporated herein in its entirety.

Figure 1:
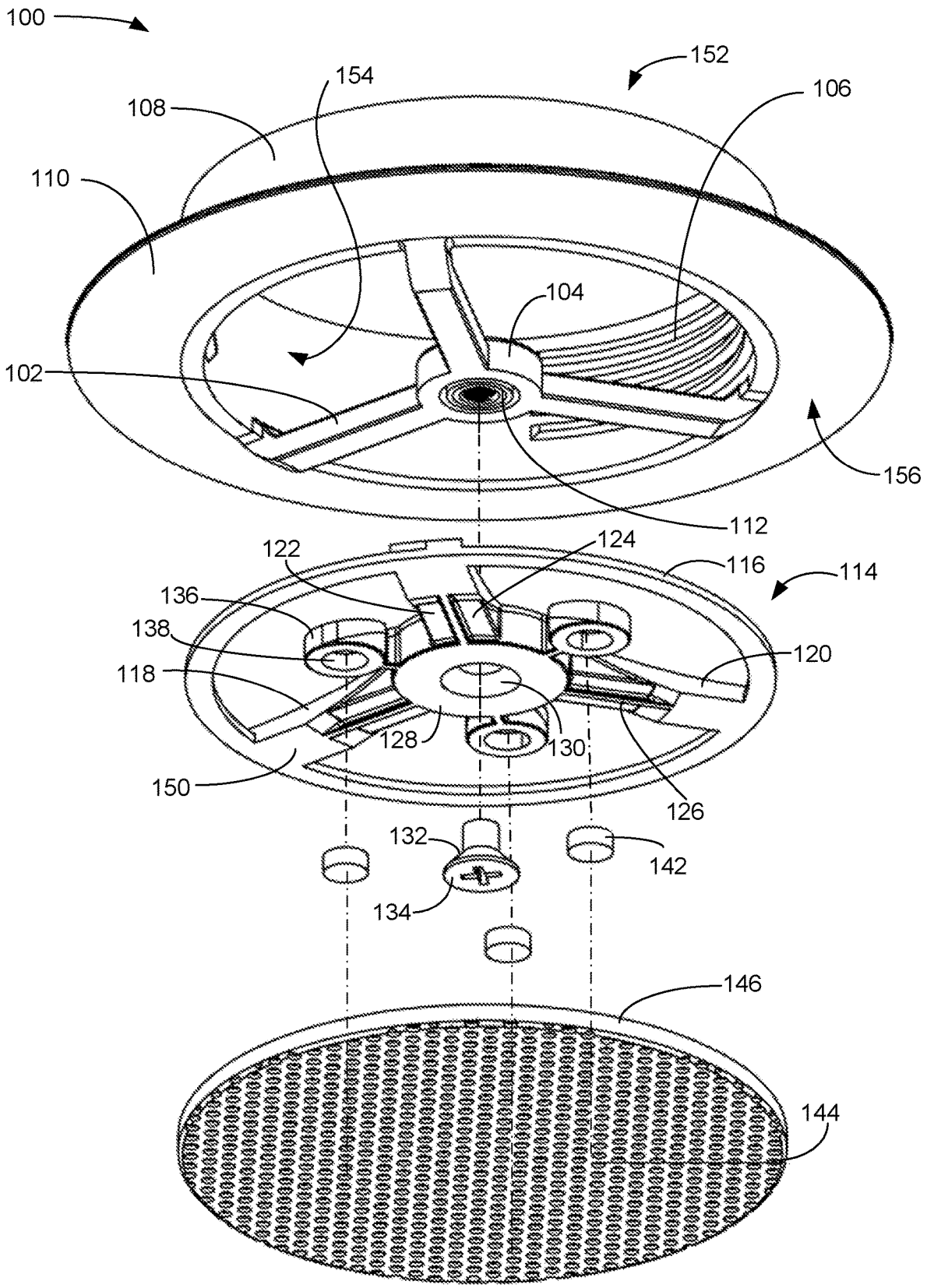
FIG. 1 is a side-bottom perspective exploded view illustrating an exemplary embodiment of the director of the direct fire small ceiling subwoofer speaker system, according to a preferred embodiment of the present invention.

FIG. 1 is a side-bottom perspective exploded view illustrating an exemplary embodiment of the director 100 of direct fire small ceiling subwoofer speaker system 700 (see FIG. 7), according to a preferred embodiment of the present invention. The director interface 152 has a cylindrical shell body 108 with partial sectional threads 106 (one visible set of two opposing sets labeled) on an internal surface 154 of the cylindrical shell body 108, an annular flange 110 extending radially from a bottom external portion of the cylindrical shell body 108, and three spokes 102 (one of three labeled)

extending from a bottom interior portion of the cylindrical shell body 108. Annular flange 110 has a radially arcuate lower surface 156. Spokes 102 have predetermined cross sections, illustrated here as rectangular, and meet at a common hub 104. In various other embodiments, respective other cross-sectional shapes may be used for spokes 102. Spokes 102 extend below annular flange 110. Hub 104 has a threaded fastener receiver 112 for receiving the threaded end of threaded fastener 132, illustrated here as screw 132. Partial sectional threads 106 are for adjusting the distance between the annular flange 110 and the bottom panel 706 (see FIG. 7), to adapt to different thicknesses of ceiling tile. Director interface 152 is similar to the cylindrical portion of the diffuser of U.S. patent application Ser. No. 15/710,654 and, in a preferred embodiment, are interchangeable. The illustrated pattern of spokes 102 is merely exemplary: in various embodiments, other patterns and numbers of spokes 102 may be used. Preferably, the director interface 152 is of one piece.

Direct fire ring 114 has an annular frame 116 and three direct fire ring spokes 150 (one of three labeled) extending radially inward from the direct fire ring 114 to join ring hub 128. Each direct fire ring spoke 150 has a left side 118 (looking radially outward, one of three labeled) and a right side 120 (looking radially outward, one of three labeled) that will define a channel 302 (See FIG. 3) for receiving portions of spokes 102 (one of three labeled). Channel bottom section undersides 122 and 124 (one of three of each labeled) are divided by a vertical support flange 126 (one of three labeled). Ring hub 128 has a beveled fastener receiver 130 for receiving the head of fastener 134, illustrated as a countersink screw 134, for attaching the direct fire ring 114 to the director interface 152. Ring hub 128 also supports three magnet cups 136 (one of three labeled), each having a cavity 138 for receiving and retaining a magnet 142 (one of three labeled). Direct fire ring 114 is preferably of one piece. In various embodiments, direct fire ring 114 may have more or fewer ring spokes 150 in respective various configurations, corresponding to the number and configuration of spokes 102.

Audio speaker grill 144 is foraminous and magnetically attachable and releasable using magnets 142 (one of three labeled). Audio speaker grill 144 has an upwardly extending rim 146 that fits around annular frame 116 of direct fire ring 114 during assembly.

Figure 2:
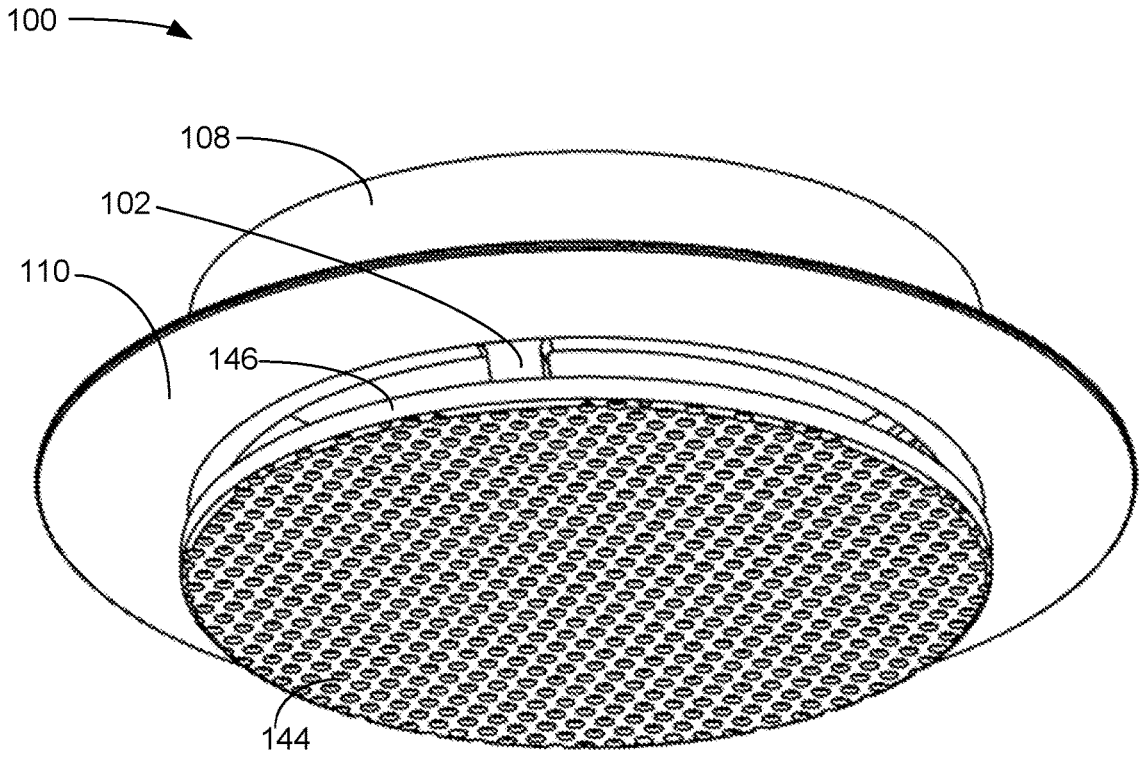
FIG. 2 is a bottom perspective view illustrating the exemplary embodiment of the director of FIG. 1 of the direct fire small ceiling subwoofer speaker system of FIG. 7, according to a preferred embodiment of the present invention.
Figure 7:
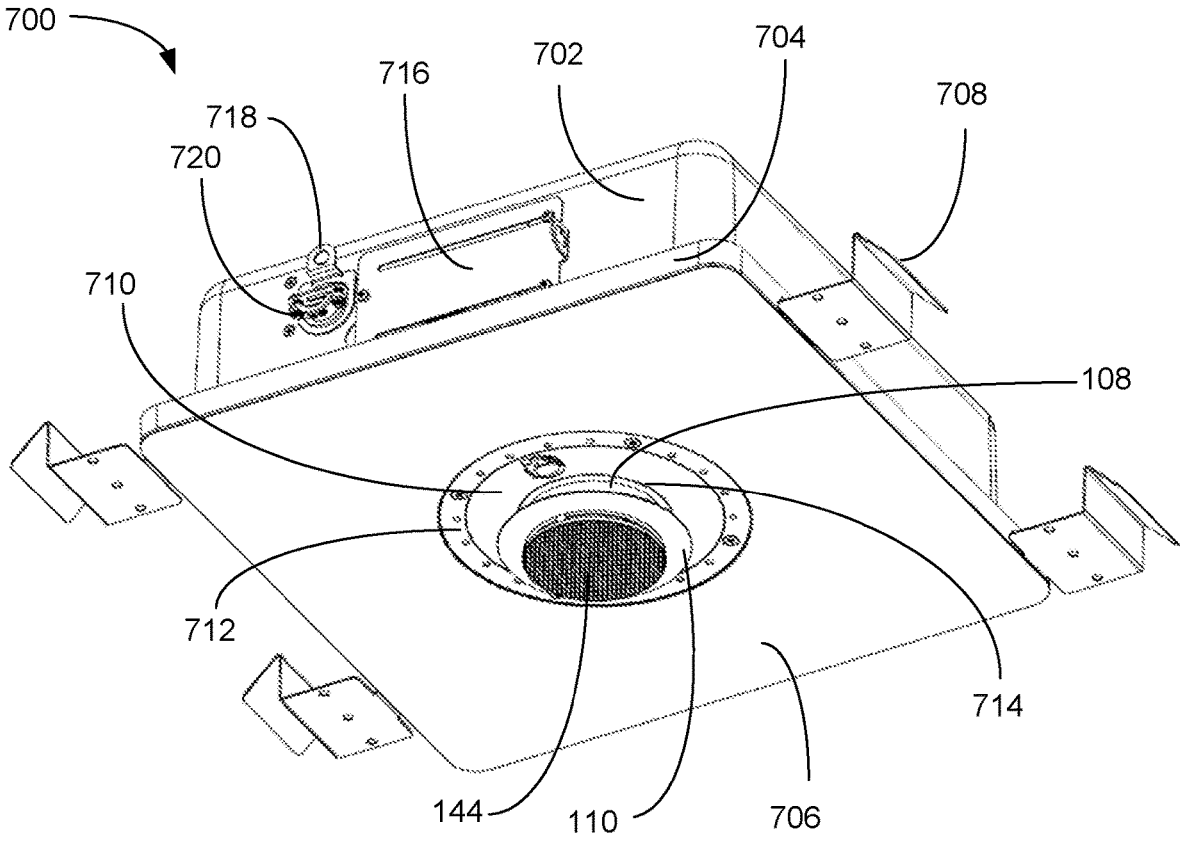
FIG. 7 is a bottom perspective view illustrating the exemplary embodiment of the director 100 of FIG. 1 installed in a small ceiling speaker system of U.S. patent application Ser. No. 15/710,654 to form the direct fire small ceiling subwoofer speaker system, according to a preferred embodiment of the present invention.

FIG. 2 is a bottom perspective view illustrating the exemplary embodiment of the director 100 of FIG. 1 of the direct fire small ceiling subwoofer speaker system 700 of FIG. 7, according to a preferred embodiment of the present invention. In this assembled configuration, director 100 can be attached to acoustic channel shell 1006 (see FIG. 10) of the remainder of the direct fire small ceiling subwoofer speaker system 700 (see FIG. 7). When installed, acoustic channel shell 1006 (see FIG. 10) extends through an opening 714 (see FIG. 7) in a bottom panel 706 and through an opening in a ceiling tile 802 (see FIG. 8) to threadingly engage the cylindrical shell body 108 of the direct fire small ceiling subwoofer speaker system 700 (see FIG. 7).

Figure 3:
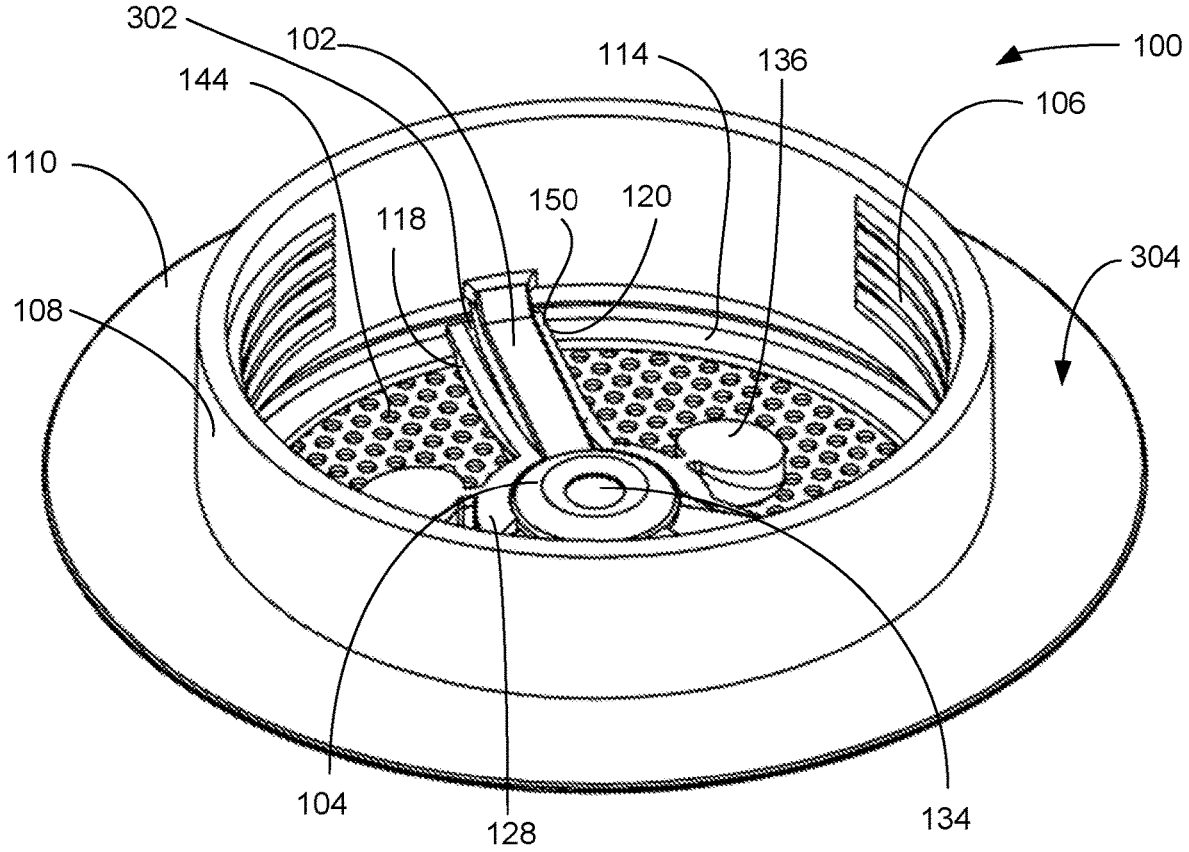
FIG. 3 is a top perspective view illustrating the exemplary embodiment of the director of FIG. 1 of the direct fire small ceiling subwoofer speaker system of FIG. 7, according to a preferred embodiment of the present invention.

FIG. 3 is a top perspective view illustrating the exemplary embodiment of the director 100 of the direct fire small ceiling subwoofer speaker system of FIG. 7, according to a preferred embodiment of the present invention. A lower portion of spoke 102 of the director interface 152 is within a channel 302 formed between left 118 and right 120 sides of direct fire ring spoke 150. Direct fire ring spokes 150 are alignable to spokes 102 in any configuration. The end of fastener 134 is visible in hub 104 which is aligned with ring hub 128. Annular flange 110 has a flat top surface 304.

Figure 4:
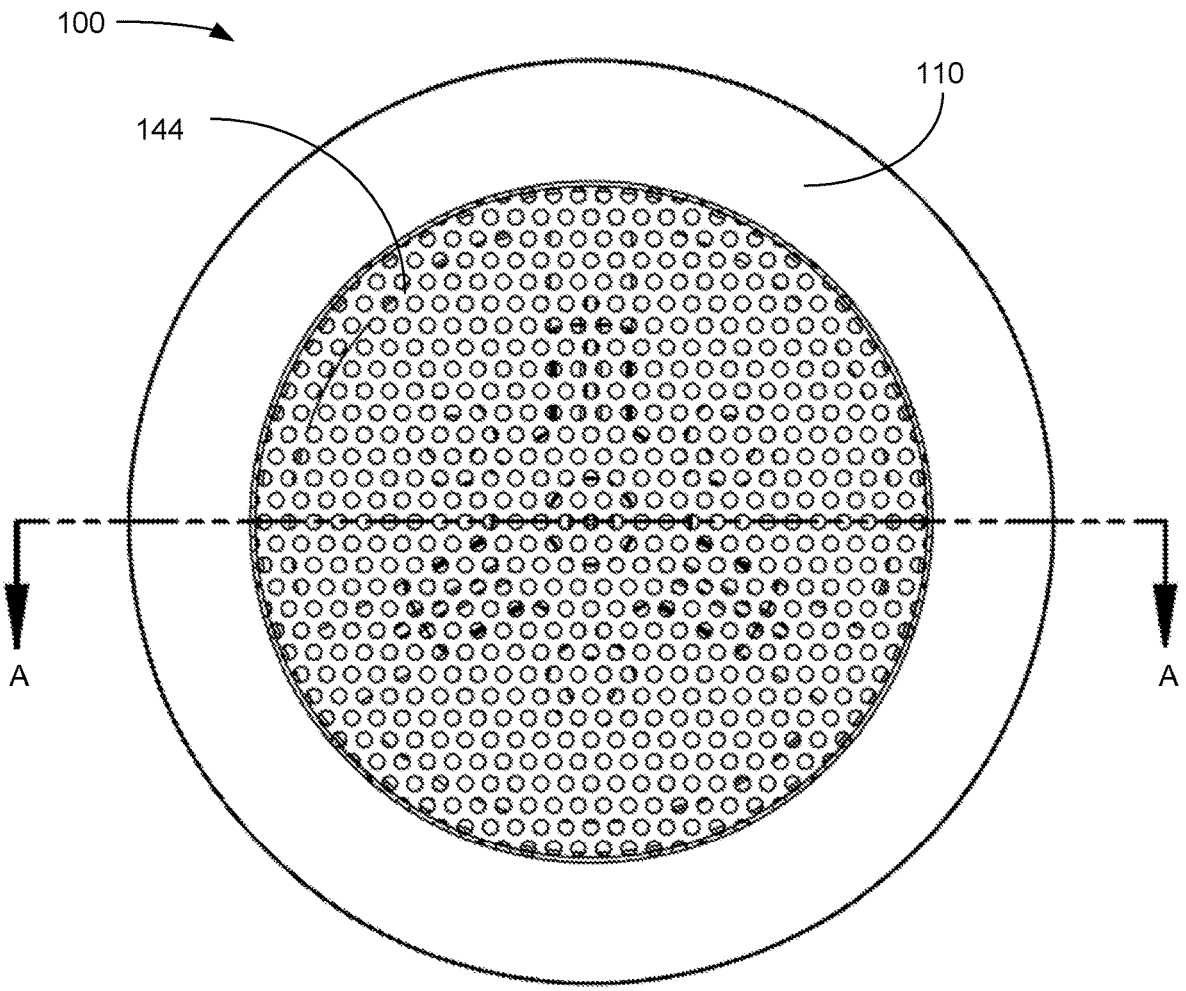
FIG. 4 is a bottom plan view illustrating the exemplary embodiment of the director of FIG. 1 of the direct fire small ceiling subwoofer speaker system of FIG. 7 and defining cross section AA, according to a preferred embodiment of the present invention.

FIG. 4 is a bottom plan view illustrating the exemplary embodiment of the director 100 of FIG. 1 of the direct fire small ceiling subwoofer speaker system 700 of FIG. 7 and defining cross section AA, according to a preferred embodiment of the present invention. Foraminous audio speaker grill 144 is releasably attached to the direct fire ring 114 by magnets 142. Cross section AA does not pass through the magnet cups 136.

Figure 5:
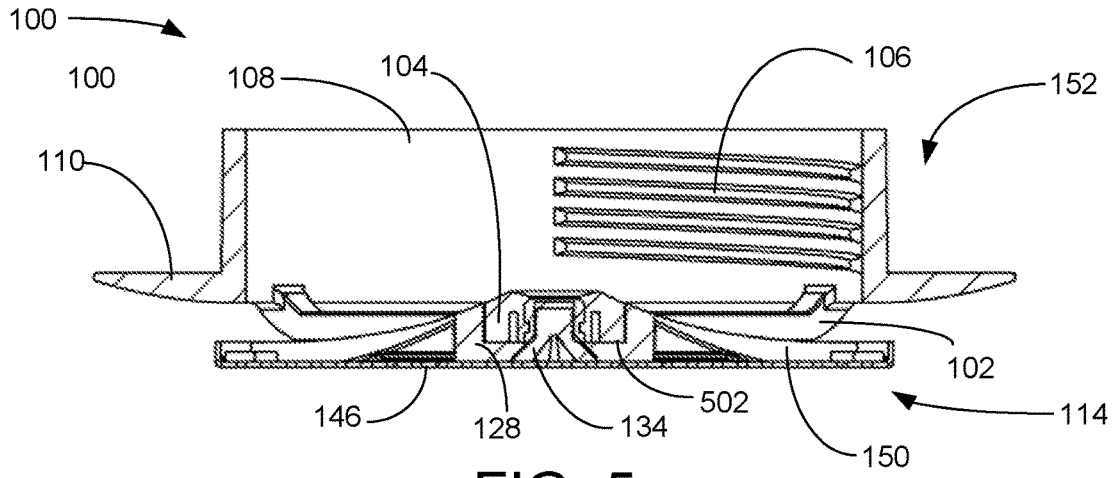
FIG. 5 is a side cross sectional view through cross section AA illustrating the exemplary embodiment of the director of FIG. 1 of the direct fire small ceiling subwoofer speaker system of FIG. 7, according to a preferred embodiment of the present invention.

FIG. 5 is a side cross sectional view through cross section AA illustrating the exemplary embodiment of the director 100 of FIG. 1 of the direct fire small ceiling subwoofer speaker system 700 of FIG. 7, according to a preferred embodiment of the present invention. The partial nesting of spokes 102 within direct fire ring spokes 150 is visible in this view. Fastener 134 extends through ring hub 128 and threads into hub 104 to fasten direct fire ring 114 to director interface 152. Center hub 104 partially nests within a cavity 502 in the top of fire ring hub 128, as shown.

Figure 6:
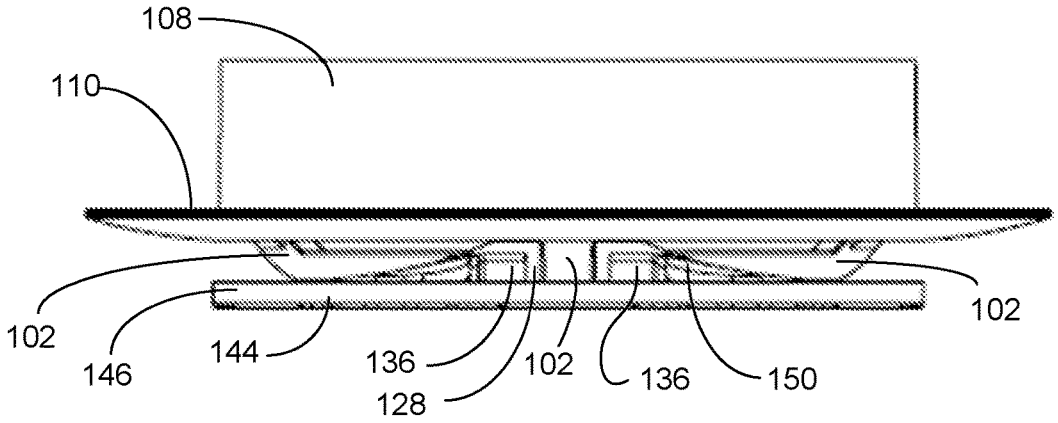
FIG. 6 is a side elevation view illustrating the exemplary embodiment of the director of FIG. 1 the direct fire small ceiling subwoofer speaker system of FIG. 7, according to a preferred embodiment of the present invention.

FIG. 6 is a side elevation view illustrating the exemplary embodiment of the director 100 of FIG. 1 of the direct fire small ceiling subwoofer speaker system 700 of FIG. 7, according to a preferred embodiment of the present invention. Two magnet cups 136 are visible in this view. Magnets 142 may be installed in magnet cups 136 by adhesion or similarly effective means.

FIG. 7 is a bottom perspective view illustrating the exemplary embodiment of the director 100 of FIG. 1 installed in a small ceiling speaker system of U.S. patent application Ser. No. 15/710,654 to form the direct fire small ceiling subwoofer speaker system 700, according to a preferred embodiment of the present invention. The director 100 is preferably interchangeable with the diffuser of U.S. patent application Ser. No. 15/710,654. Enclosure 702 houses two subwoofer speakers 1002 (see FIG. 10) and 1004 (see FIG. 10), and associated electronics 1012 (see FIG. 10). Enclosure 702 features an access panel 716, a strain relief 718, electrical connectors 720, and a rim 704. Bottom panel 706 is secured within rim 704 and provides a carrier 710 for the subwoofer speakers 1002 and 1004 that is fastened to the bottom panel 706 using fastener ring 712, which is a radially outer annular portion of carrier 710. Opening 714 in carrier 710 admits the acoustic channel shell 1006 (see FIG. 10) to be slidingly engaged and then threadingly attached to the cylindrical shell body 108. Enclosure 702 has four independently extendable braces 708 (one of four labeled) to support the enclosure 702 on the ceiling tile supports 804 (See FIG. 8), rather than on the ceiling tile 802 (see FIG. 8) itself. Ceiling tile supports 804 are grid members of a suspended ceiling grid system.

FIG. 8 is a side elevation view illustrating the exemplary embodiment of the direct fire small ceiling subwoofer speaker system 700 of FIG. 7, according to a preferred embodiment of the present invention. The four independently extendable braces 708 (one of four labeled). support the enclosure 702 on the ceiling tile supports 804, rather than on the ceiling tile 802 itself. Director 100 can be slidingly engaged and then threadably adjusted to accommodate ceiling tiles 802 of various thicknesses 806. Ceiling tile support 804 is shown with independently extendable brace 708 engaged.

Figure 9:
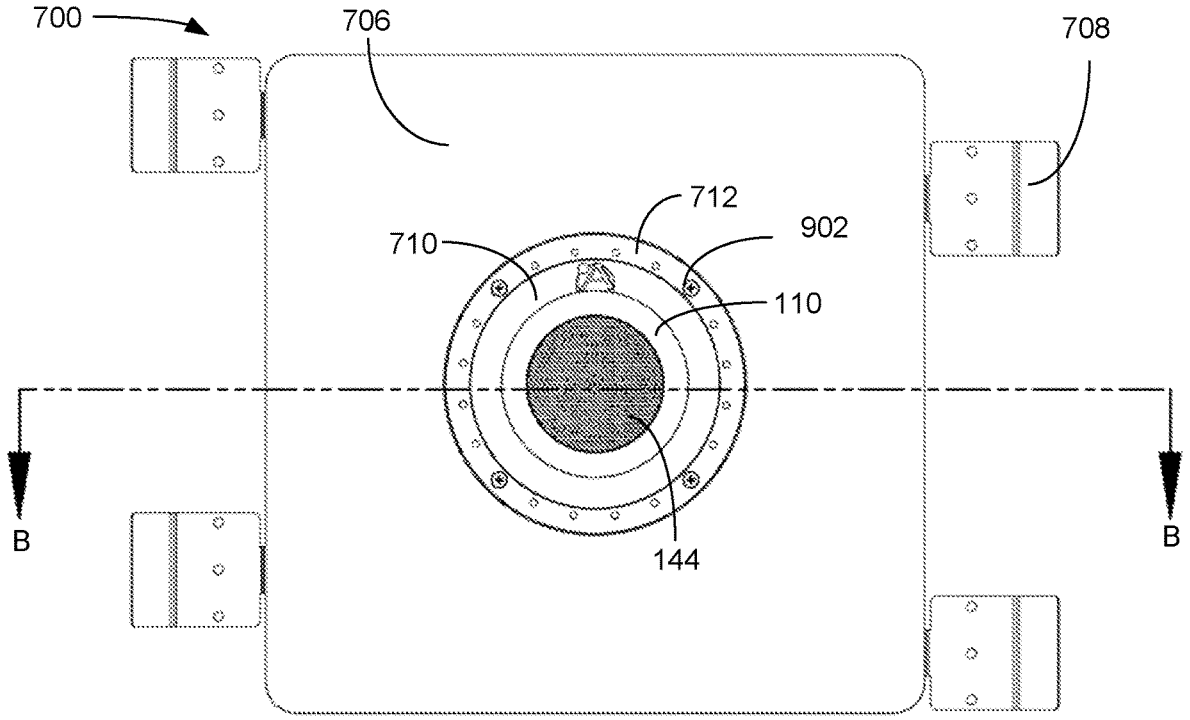
FIG. 9 is a bottom plan view illustrating the exemplary embodiment of the direct fire small ceiling subwoofer speaker system of FIG. 7 and defining a cross section BB, according to a preferred embodiment of the present invention.

FIG. 9 is a bottom plan view illustrating the exemplary embodiment of the direct fire small ceiling subwoofer speaker system 700 of FIG. 7 and defining a cross section BB, according to a preferred embodiment of the present invention. When installed in a ceiling, only audio speaker grill 144 and annular flange 110 would be visible in this view.

FIG. 10 is a cross sectional elevation view through cross section BB illustrating the exemplary embodiment of the direct fire small ceiling subwoofer speaker system 700 of FIG. 7, according to a preferred embodiment of the present invention. Independently extendable braces 708 are used with this embodiment but are not shown for simplicity of the drawing. Subwoofer speakers 1002 and 1004 are preferably similar and receive the same audio signals at the same amplitude, so the subwoofer sound outputs reinforce each other. Subwoofer speakers 1002 and 1004 are supported on a carrier 710 that is attached to the enclosure 702 via screws 902 (one of two visible labeled) through fastener ring 712, into internal structure 1032 extending upward from bottom panel 706, through screw housing 1026. Screw housing 1026 is supported by casing 1028 (one of two visible labeled). Basket flanges 1008 (one of two visible labeled) extend from the carrier 710 to support subwoofer speakers 1002 and 1004. In a particular embodiment, vibration damping materials may be used between the basket flange 1008 and the basket rim 1022 and 1024 to suppress vertical vibrations of the carrier 710 and enclosure 702. Subwoofer speakers 1002 and 1004 are preferably arranged on the carrier 710 so that the carrier 710, with the subwoofer speakers 1002 and 1004 mounted, can be inserted into an enclosure 702 like that disclosed for other small speaker systems, such as that in U.S. patent application Ser. No. 15/710,654. Support 1030 extends between basket rims 1022 and 1024 of subwoofer speakers 1002 and 1004, respectively, and may include vibration damping materials at the connection points between the support 1030 and the basket rims 1022 and 1024.

Subwoofer speakers 1002 and 1004 have axes 1014 and 1016, respectively through the long axis center of their respective cylindrical formers 1034 and 1036. Axes 1014 and 1016 are coplanar and preferably intersect at a point 1018 within the conical portion 1020 of acoustic channel shell 1006. Subwoofer speakers 1002 and 1004 are shown in a horizontally opposed diagonally downward-pointed orientation. In operation, the horizontal component of the vibrations induced in the carrier 710 and enclosure 702 cancel out due to the alignment of axes 1014 and 1016. Cylindrical shell body 108 can be seen threadingly engaged with acoustic channel shell 1006. Associated electronics within enclosure 702 are not limited to transformer 1012, which may have selectable multiple taps.

Figure 11:
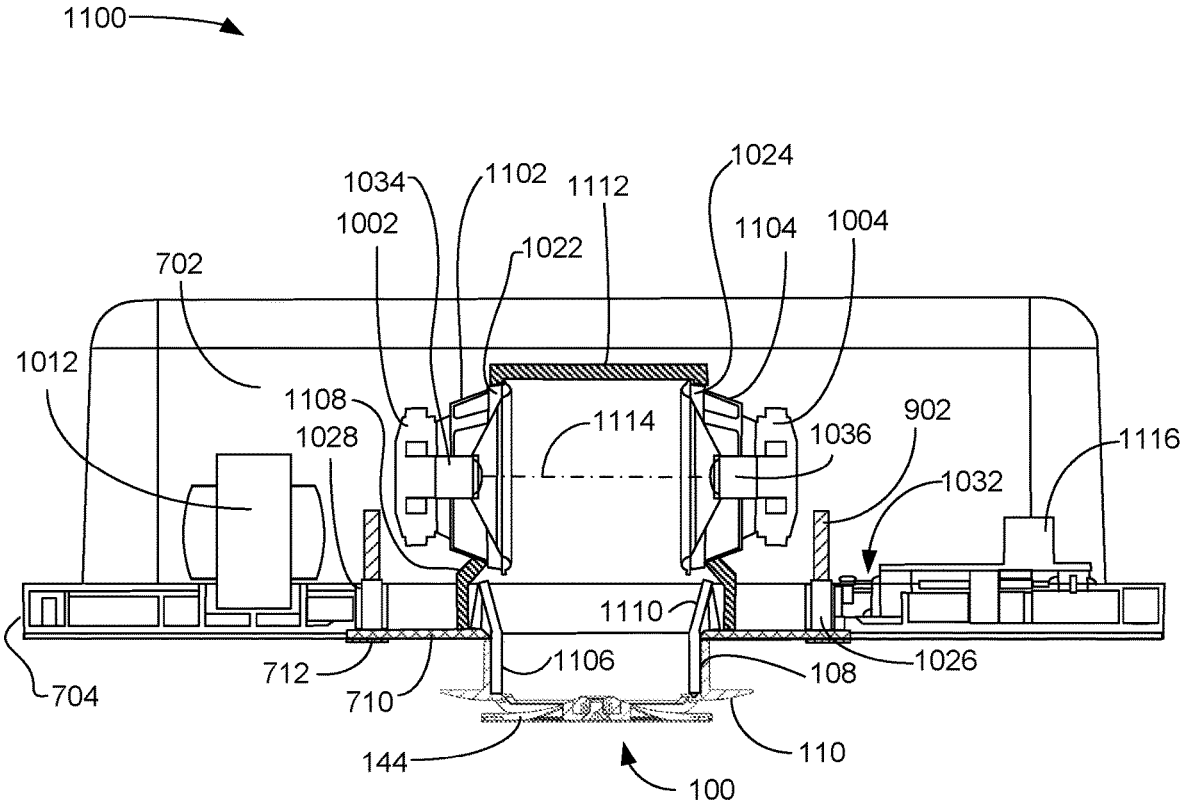
FIG. 11 is a cross sectional elevation view through cross section BB illustrating a second exemplary embodiment of the direct fire small ceiling subwoofer speaker system of FIG. 1 and FIG. 7, according to a preferred embodiment of the present invention.

FIG. 11 is a cross sectional elevation view through cross section BB illustrating a second exemplary embodiment of the direct fire small ceiling subwoofer speaker system 1100 of FIG. 1 and FIG. 7, according to a preferred embodiment of the present invention. Independently extendable braces 708 are used with this embodiment but are not shown for simplicity of the drawing. Subwoofer speakers 1002 and 1004 are preferably similar and receive the same audio signals at the same amplitude, so the subwoofer sound outputs reinforce each other. In a particular embodiment, the audio signal inputs to subwoofer speakers 1002 and 1004 are phased such that when subwoofer 1002 pushes, subwoofer 1004 pulls, and vice versa, thereby increasing the power in the moving air and thus, the sound output. The phasing of audio signal inputs is accomplished using an audio signal processor 1116. Subwoofer speakers 1002 and 1004 are supported on a carrier 710 that is attached to the enclosure 702 via screws 902 (one of two visible labeled) through fastener ring 712, into internal structure 1032 extending upward from bottom panel 706, through screw housing 1026. Screw housing 1026 is supported by casing 1028 (one of two visible labeled). Basket flanges 1108 (one of two visible labeled) extend from the carrier 710 to support subwoofer speakers 1002 and 1004. In a particular embodiment, vibration damping materials may be used between the basket flange 1108 and the baskets 1102 and 1104 10 to suppress vibrations of the carrier 710 and enclosure 702. Subwoofer speakers 1002 and 1004 are preferably arranged on the carrier 710 so that the carrier 710, with the subwoofer speakers 1002 and 1004 mounted, can be inserted into an enclosure 702 like that disclosed for other small speaker systems, such as that in U.S. patent application Ser. No. 15/710,654. Support 1112 extends between basket rims 1022 and 1024 of subwoofer speakers 1002 and 1004, respectively, and may include vibration damping materials at the connection points between the support 1112 and the basket rims 1022 and 1024.

Subwoofer speakers 1002 and 1004 have colinear axes 1114 respectively through the long axis center of their respective cylindrical formers 1034 and 1036. Colinear axes 1114 and 1016 are colinear and preferably align above the conical portion 1110 of acoustic channel shell 1106. Subwoofer speakers 1002 and 1004 are shown in a horizontally opposed orientation. In operation, the horizontal component of the vibrations induced in the carrier 710 and enclosure 702 cancel out due to the alignment of colinear axes 1114. Cylindrical shell body 108 can be seen threadingly engaged with acoustic channel shell 1106. Associated electronics within enclosure 702 are not limited to transformer 1012, which may have selectable multiple taps.

Points of novelty for this invention include interchangeability of the enclosure 702 with the enclosure of a preexisting system, the positioning of the subwoofer speakers on the carrier 710, the provision of subwoofer sound through a small acoustic orifice, and the vibration-reducing configuration of subwoofer speakers 1002 and 1004. Director 100 produces a small acoustic footprint, which is a further advantage, and so enables the use of one design of small ceiling speaker system for both diffuse and directed sound systems.

The claims below contain functional claims and do not include any statements of intended purpose.

I claim:

1. A small subwoofer ceiling speaker system comprising:

a. a ceiling speaker enclosure having a bottom opening sized to receive a subwoofer carrier;

b. first and second subwoofer speakers mountable on said carrier, wherein said first and second subwoofer speakers have one of:

i. coplanar intersecting long central axes when mounted; and ii. colinear long central axes when mounted;

c. a partially threaded acoustic channel shell configured to conduct outputs from said first and second subwoofer speakers out of said speaker enclosure;

d. wherein said partially threaded acoustic channel shell comprises:

a. a cylindrical shell fixed in said subwoofer carrier; and b. a conical shell extending upward from said cylindrical shell and fixed in said subwoofer carrier; and e. a director adjustably and threadedly engageable to said partially threaded acoustic channel shell and operable, when so engaged, to direct projected sound one of:

i. downward; and ii. horizontally.

2. The system of claim 1, comprising a plurality of braces configured to rest on grid members of a suspended ceiling system, wherein said braces are mounted on a corresponding plurality of rails, respectively.

3. The system of claim 2, wherein each rail of said plurality of rails is independently extendable from said enclosure.

4. The system of claim 1, comprising an audio signal controller, wherein audio inputs to said first and second subwoofer speakers are phased such that said first subwoofer speaker pushes when said second subwoofer speaker pulls, and vice versa.

5. The system of claim 1, wherein said long central axes one of:

a. intersect inside a conical portion of said partially threaded acoustic channel shell; and b. align colinearly above a conical portion of said partially threaded acoustic channel shell.

6. The system of claim 1, wherein said first and second subwoofer speakers are:

a. horizontally spaced apart;

b. opposed; and c. supported in one of:

i. a diagonally downward-pointed orientation; and ii. horizontally axially aligned.

7. The system of claim 6, comprising at least one carrier support extending from a base panel of said subwoofer carrier and attached to one of a rim and a basket of at least one subwoofer speaker.

8. The system of claim 7, comprising a basket support extending between respective first and second baskets of said first and second subwoofer speakers.

9. The system of claim 8, wherein:

a. said carrier support comprises vibration damping materials; and b. said basket support comprises vibration damping materials.

10. The system of claim 1, wherein:

a. said partially threaded acoustic channel shell comprises two sets of circumferentially spaced apart opposed sets of exterior threads;

b. said director comprises a director interface having a cylindrical shell body further comprising two sets of circumferentially spaced apart opposed sets of interior threads corresponding to said exterior threads of said partially threaded acoustic channel shell.

11. A small subwoofer ceiling speaker system comprising:

a. a ceiling speaker enclosure having a bottom opening sized to receive a subwoofer carrier;

b. first and second subwoofer speakers mountable on said carrier, wherein said first and second subwoofer speakers have one of:

i. coplanar intersecting long central axes when mounted; and ii. colinear long central axes when mounted;

c. a partially threaded acoustic channel shell configured to conduct outputs from said first and second subwoofer speakers out of said speaker enclosure;

d. wherein said partially threaded acoustic channel shell comprises:

i. a cylindrical shell fixed in said subwoofer carrier; and ii. a conical shell extending upward from said cylindrical shell and fixed in said subwoofer carrier;

e. a director adjustably and threadedly engageable to said partially threaded acoustic channel shell and operable, when so engaged, to direct projected sound one of:

i. downward; and ii. horizontally; and f. wherein said long central axes one of:

i. intersect inside a conical portion of said partially threaded acoustic channel shell; and ii. align colinearly above a conical portion of said partially threaded acoustic channel shell.

12. The system of claim 11 comprising a plurality of braces configured to rest on grid members of a suspended ceiling system, wherein said braces are mounted on a corresponding plurality of rails, respectively; wherein each rail of said plurality of rails is independently extendable from said enclosure.

13. The system of claim 11, comprising:

a. a basket support extending between respective first and second baskets of said first and second subwoofer speakers; and b. at least one carrier support extending from a base panel of said subwoofer carrier and attached to one of a rim and a basket of at least one said subwoofer speaker.

14. The system of claim 11, wherein said first and second subwoofer speakers are:

a. horizontally spaced apart;

b. opposed; and c. supported in one of:

i. a diagonally downward-pointed orientation; and ii. horizontally axially aligned.

15. The system of claim 11, comprising an audio signal controller, wherein audio inputs to said first and second subwoofer speakers are phased such that said first subwoofer speaker pushes when said second subwoofer speaker pulls, and vice versa.

16. The system of claim 11, wherein:

a. said partially threaded acoustic channel shell comprises two sets of circumferentially spaced apart opposed sets of exterior threads; and b. said director comprises a director interface having a cylindrical shell body further comprising two sets of circumferentially spaced apart opposed sets of interior threads corresponding to said exterior threads of said partially threaded acoustic channel shell.

17. A small subwoofer ceiling speaker system comprising:

a. a ceiling speaker enclosure having a bottom opening sized to receive a subwoofer carrier;

b. first and second subwoofer speakers mountable on said carrier, wherein said first and second subwoofer speakers have one of:

i. coplanar intersecting long central axes when mounted; and ii. colinear long central axes when mounted;

c. a partially threaded acoustic channel shell configured to conduct outputs from said first and second subwoofer speakers out of said speaker enclosure;

d. wherein said partially threaded acoustic channel shell comprises:

i. a cylindrical shell fixed in said subwoofer carrier; and ii. a conical shell extending upward from said cylindrical shell and fixed in said subwoofer carrier;

g. wherein:

i. said partially threaded acoustic channel comprises a cylindrical shell body that further comprises two sets of circumferentially spaced apart opposed sets of exterior threads; and ii. said director comprises a director interface having a cylindrical shell body further comprising two sets of circumferentially spaced apart opposed sets of interior threads corresponding to said exterior threads of said partially threaded acoustic channel shell;

h. said director adjustably and threadedly engageable to said partially threaded acoustic channel shell and operable, when so engaged, to direct said projected sound one of:
   i. downward; and
   ii. horizontally; and i. wherein said first and second subwoofer speakers are:
   i. horizontally spaced apart;
   ii. opposed; and
   iii. supported in one of:
      1. a diagonally downward-pointed orientation; and
      2. horizontally axially aligned; and j. wherein said long central axes one of:
   i. intersect inside a conical portion of said partially threaded acoustic channel shell; and
   ii. align colinearly above a conical portion of said partially threaded acoustic channel shell.

18. The system of claim 17, comprising:

a. a plurality of braces configured to rest on grid members of a suspended ceiling system, wherein said braces are mounted on a corresponding plurality of rails, respectively; wherein each rail of said plurality of rails is independently extendable from said enclosure;

b. a basket support extending between respective first and second baskets of said first and second subwoofer speakers; and c. at least one carrier support extending from a base panel of said subwoofer carrier and attached to one of a rim and a basket of at least one said subwoofer speaker.

19. The system of claim 17, comprising an audio signal controller, wherein audio inputs to said first and second subwoofer speakers are phased such that said first subwoofer speaker pushes when said second subwoofer speaker pulls, and vice versa.

* * * * *